US005555007A

United States Patent [19]

Ceschin et al.

[11] Patent Number: 5,555,007

[45] Date of Patent: Sep. 10, 1996

[54] REFILLABLE INK JET PRINTING MODULE

[75] Inventors: Danilo Ceschin, Candia Canavese; Rinaldo Ferrarotti, Trino Vercellese; Roberto Morandotti, Mercenasco; Alessandro Scardovi, Ivrea, all of Italy

[73] Assignee: Olivetti-Canon Industriale, S.p.A., Turin, Italy

[21] Appl. No.: 301,015

[22] Filed: Sep. 6, 1994

[30] Foreign Application Priority Data

Sep. 23, 1993 [IT] Italy ..... TO93A0694

[51] Int. Cl.[6] ..... B41J 2/175

[52] U.S. Cl. ..... 347/87; 347/85; 222/83.5; 222/86

[58] Field of Search ..... 347/85, 86, 87, 347/108; 222/83.5, 86, 481.5

[56] References Cited

U.S. PATENT DOCUMENTS

| | | | |
|---|---|---|---|
| 1,364,889 | 1/1921 | Rupp | 222/83.5 |
| 1,426,180 | 8/1922 | Gotfredsen | 222/83.5 |
| 1,635,563 | 7/1927 | Sanford | 222/83.5 |
| 4,623,905 | 11/1986 | Ichihashi et al. | 347/86 |
| 5,023,629 | 6/1991 | Kiyohara | 346/140 R |
| 5,113,205 | 5/1992 | Sato et al. | 347/85 |
| 5,280,300 | 1/1994 | Fong et al. | 346/1.1 |
| 5,453,771 | 9/1995 | Waseda et al. | 347/86 |

FOREIGN PATENT DOCUMENTS

| | | | |
|---|---|---|---|
| 0320165 | 6/1989 | European Pat. Off. . | |
| 408241 | 1/1991 | European Pat. Off. | 347/86 |
| 0496642 | 7/1992 | European Pat. Off. . | |
| 536980 | 4/1993 | European Pat. Off. | 347/85 |
| 0567308A2 | 10/1993 | European Pat. Off. . | |
| 188261 | 7/1990 | Japan | 347/85 |
| 3032850 | 2/1991 | Japan . | |
| 288652 | 12/1991 | Japan | 347/86 |
| 1056 | 1/1992 | Japan | 347/86 |
| 008405 | 1/1993 | Japan | 347/86 |
| 5057902 | 3/1993 | Japan . | |
| 77438 | 3/1993 | Japan | 347/86 |
| 5096743 | 4/1993 | Japan . | |
| 5096744 | 4/1993 | Japan . | |

*Primary Examiner*—N. Le
*Attorney, Agent, or Firm*—Banner & Allegretti, Ltd.

[57] ABSTRACT

A thermal ink jet printing module, of the type that can be removably mounted on the carriage of a printer, comprises a reservoir for the ink and a thermal ink jet printing head fixed to and communicating with the reservoir, and a housing integral with the reservoir for receiving an ink refill cartridge for supplying the spent module with fresh ink by means of a transfer element integral with the housing of the cartridge. Successive refilling of the printing module exploits the working life of the head to the utmost and reduces the waste of expensive materials. The reservoir can be refilled relatively easily, even when the user is travelling.

11 Claims, 3 Drawing Sheets

REFILLABLE INK JET PRINTING MODULE

This invention relates to a refillable ink jet printing module, and more particularly to a so-called integrated thermal ink jet printing module comprising a thermal printing head integral with the associated reservoir for the ink, of the type removably mounted on the carriage of ink jet printers, for example those associated with a personal computer.

Printing modules of the type mentioned are known in the art. For example an integral printing module which can be removably inserted in a printer is known from International (PCT) Patent Application WO 91/04861 published on Apr. 18, 1991 (corresponding U.S. Pat. No. 5,317,339 issued May 31, 1994). The reservoir for the ink contains a spongy body impregnated with ink, and the printing head is formed by a plate integral with the reservoir and provided with a plurality of nozzles from which the ink is expelled by means of a rapid increase in pressure in compression chambers connected to the nozzles.

The working life of the ink contained in the reservoir is normally much shorter than the life of the head and it is therefore very expensive to replace a spent module with another one full of ink as this involves the loss of a printing head which is still in working order.

The problem of the replacement of a spent integral module and the consequent loss of the associated printing head still in working order is particularly apparent in the case of the small printers associated with a portable (lap top) personal computer. In equipment of this kind, the ink jet printing module generally has small dimensions and can contain approximately 6 $cm^3$ of ink. It therefore has to be replaced more frequently than in the case of desk-top printers. Moreover, given the specific use of this equipment, used mainly by people working while travelling, the replacement of a spent integral module involves considerable practical problems, for instance the need to have a supply of new modules close at hand, thereby taking up more luggage space.

The storage or disposal of spent modules also poses problems in certain circumstances. The replacement of a spent module is generally a simple operation carried out calmly in a quiet place. However, in the case of a user travelling on a means of transport, operations of this kind can become extremely awkward and complicated, with the risk of incorrect mounting of the new module, making it impossible to continue with the printing already started. All of these disadvantages cause long interruptions to printing, possibly leading to a loss of print quality and which are harmful to the professional activity of the user.

An object of this invention is therefore to provide a thermal ink jet printing module capable of being refilled several times in order to make full use of the working life of the printing head associated therewith.

Another object of the invention is to associate with a refillable ink jet printing module refill cartridges with small dimensions compared to the module to be refilled, thereby reducing the problems with the transportation and disposal of the spare cartridges.

The invention in its various aspects is defined in the independent claims below, to which reference should now be made. Advantageous features are set forth in the appendent claims.

Preferred embodiments of the invention are described in more detail below with reference to the drawings. In these embodiments, a thermal ink jet printing module, of the type that can be removably mounted on the carriage of a printer, has an ink reservoir, and a thermal ink jet printing head fixed to and in communication with the reservoir. A housing is integral with the reservoir for receiving an ink refill cartridge for supplying the spent module with fresh ink, by means of a transfer element integral with the cartridge housing. In this way the reservoir can be refilled relatively easily by the user, even when the user is travelling.

BRIEF DESCRIPTION OF THE DRAWINGS

These and other features of the invention will be clearer from the following description of several preferred embodiments given by way of non-limiting examples and with reference to the accompanying drawings, in which:

With reference to FIG. 1, a thermal ink jet printing module 10 embodying the invention is shown in vertical section. In a non-limiting manner, the module 10 is of the type which can be removably mounted on the carriage (not shown) of a printer and comprises a main reservoir 12 formed by four walls 14*a*, 14*b*, 14*c* and 14*d* (FIG. 3) and a base wall 16 (FIG. 1) which closes the reservoir 12 in the lower part and which is traversed by a hole 15 for the passage of the ink.

Figure 2:
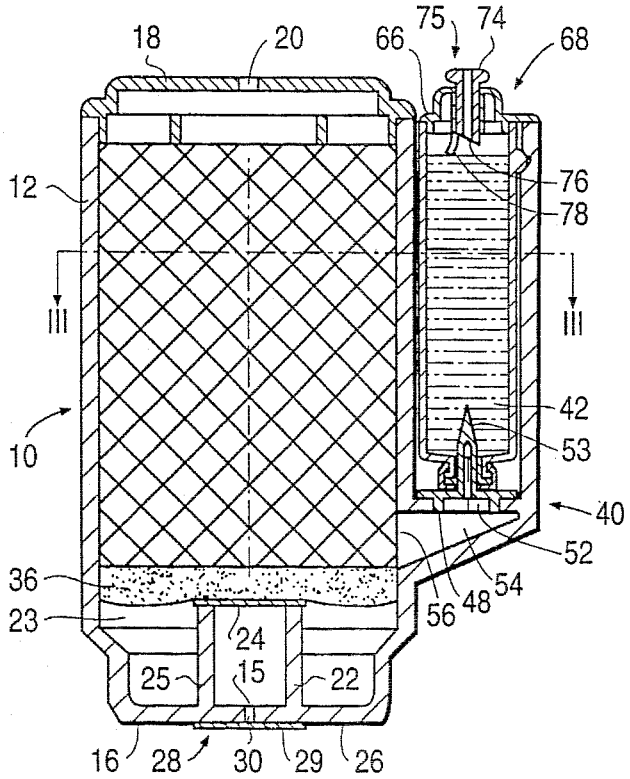
FIG. 2 is a vertical section of the module of FIG. 1 with the refill cartridge inserted.
Figure 5:
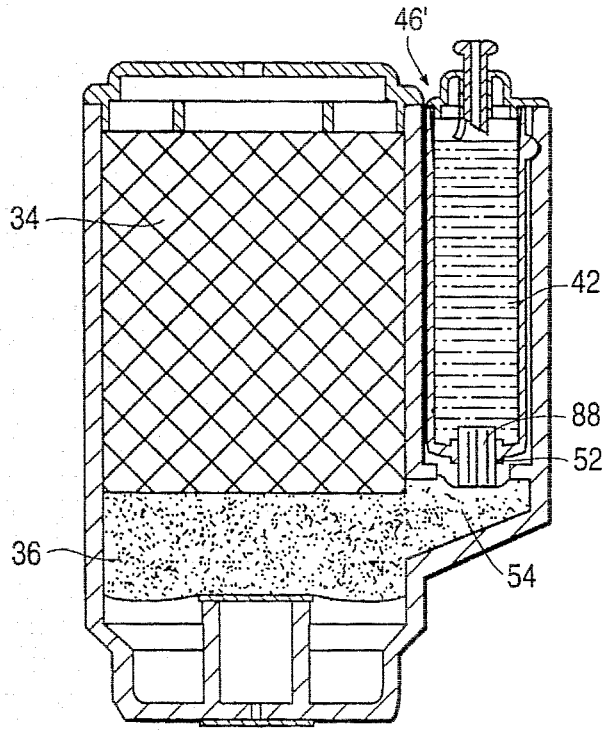
FIG. 5 is a vertical section of the module of FIG. 4 with the associated cartridge inserted.
Figure 6:
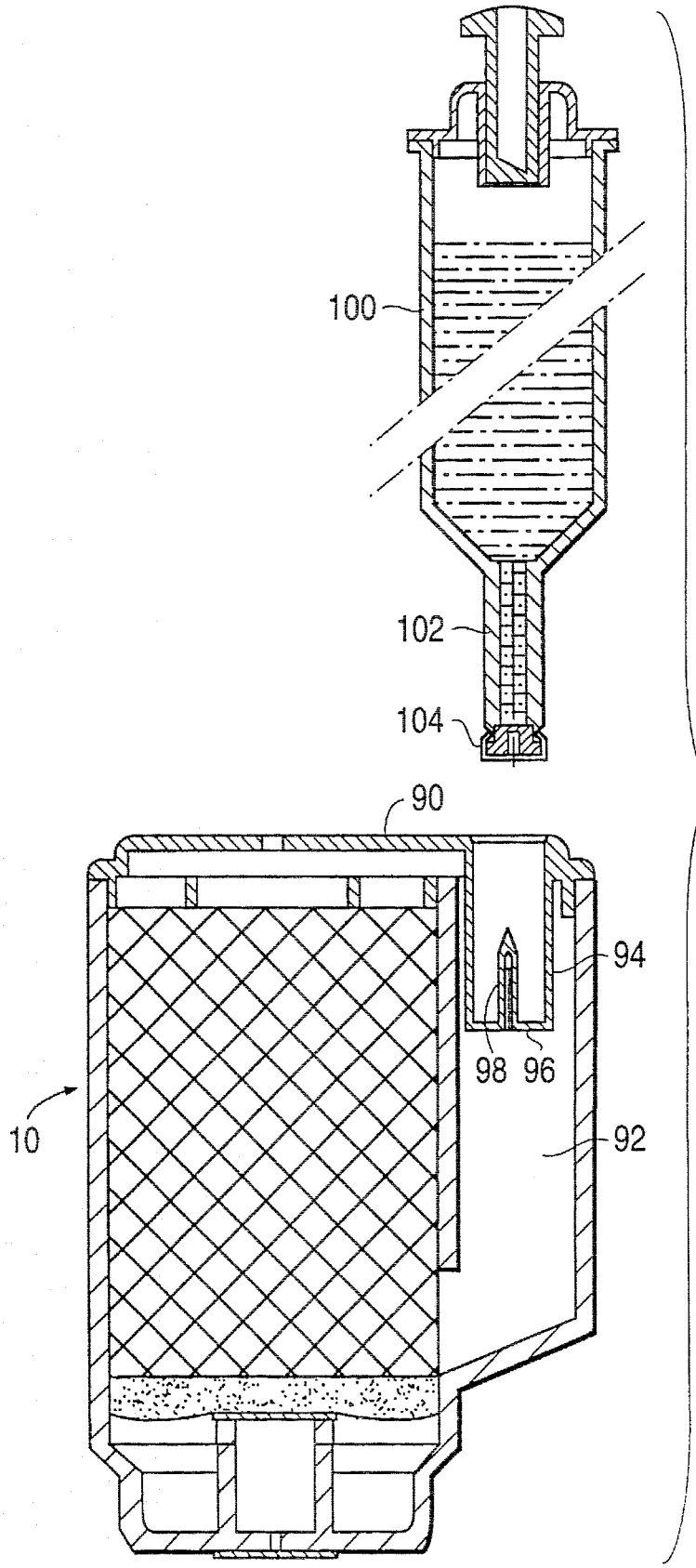
FIG. 6 shows a further embodiment of the module of FIG. 1 and the associated refill cartridge.

In the following description, reference will be made to a module 10 used on a printer (not shown) in an upright position, as can be seen in FIGS. 2, 5 and 6. A hollow sleeve 22, preferably of cylindrical shape, is fixed to the base wall 16 and extends towards the interior of the reservoir 12. An ink-permeable membrane 24 acting as a filter to hold back any impurities or air bubbles contained in the ink is disposed at the inlet 23 of the sleeve 22 directed towards the interior of the reservoir 12.

The membrane 24 can be replaced by a layer of non-woven fabric or by a very close-meshed grate, e.g. of metal resistant to the corrosive action of the ink, or formed of plastic fibers.

The space within the sleeve 22 included between the membrane 24 and the wall 16 therefore forms an ink supply chamber 25, as will be seen below.

A thermal ink jet printing head 28 formed by a plate 29 of the multi-layer type constructed on a silicon base and having a plurality of nozzles 30 communicating with corresponding expulsion chambers, each connected to a duct for distributing the ink (not shown), is fixed to the outer face 26 of the base wall 16 in correspondence with the sleeve 22. A thermal element for expelling the ink, electrically connected to external conductors by means of conductive plates built into the inner layers of the plate 29 by means of integrated circuit technology, is moreover contained in each chamber. The printing head 28 is of known type and further design features are described in Italian Patent No. 1 233 061.

The reservoir 12 is filled with an absorbent material 34, for example, sponge, or a bundle of fibers, or even with a package of layers of non-woven fabric which is impregnated with ink upon construction of the module. Once it has been filled with ink, the upper orifice 17 of the reservoir 12 is .closed by a cover 18, fixed rigidly, for example, by ultrasonic welding. The cover 18 has an orifice or aperture 20 for bringing the reservoir 12 into communication with the atmospheric pressure.

During refilling of the reservoir 12, particular care is taken to ensure that the ink completely fills the chamber 25 and the inner ducts of the plate 29 in order to ensure correct operation of the head 28.

According to a preferred non-limiting embodiment, the absorbent material 34 is formed by a package of sheets or layers of non-woven fabric, a material known in the art, and sold under various names according to the constituent material, for example:

Reemay (Registered Trade Mark of Reemay Inc.): polyester;

Tekton (Registered Trade Mark of Reemay Inc.): polypropylene;

Sontara (Registered Trade Mark of Du Pont): polyester;

Nordlys (Registered Trade Mark of Nordlys Inc.): polyamide;

These materials are formed by one or more layers of synthetic fibers arranged in a random manner on top of one another and welded together at contact points so as to form a flat structure similar to a sheet.

The sheets, cut to the desired dimensions, are placed on top of one another in a well-defined quantity so as to form a package which is inserted into the reservoir. Alternatively, the package can be obtained by accordion-pleating a web of material of this kind having the desired width.

In all cases, the number of layers making up the package must be precisely determined, as varying this number (the thickness of the sheet being equal) results in greater or lesser compaction of the fibers and thus corresponding control of the capillarity developed.

A layer of a slightly compressed spongy body 36 is inserted between the package 34 of non-woven fabric sheets and the membrane 24, its function being to ensure, by virtue of its own capillarity, that the ink flows towards the chamber 25 through the membrane 24.

In the case of a reservoir 12 with small dimensions, capable of containing approximately 5–6 $cm^3$ of ink, the working life of the ink is considerably shorter than the life of the head 28. Therefore, in order to avoid having to throw away the spent module 10 with the associated printing head 28 still in working order, the module 10 is adapted to receive a refill cartridge which can be inserted in a simple manner in order to refill the reservoir 12 with fresh ink, and which can likewise be removed again in a simple manner for future refilling.

Figure 3:
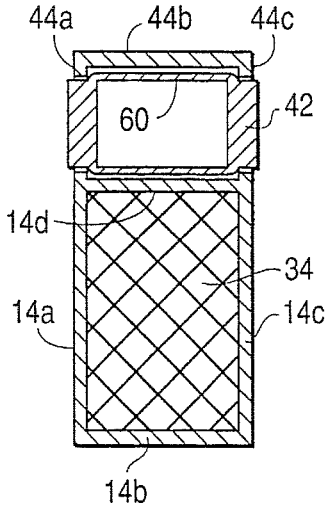
FIG. 3 is a horizontal section of the module of FIG. 2 along the line III—III.

A supporting structure 40 or holding means (FIGS. 1–3) adapted to receive and to contain an ink refill cartridge 42 for the main reservoir 12 is fixed near one wall 14 of the reservoir 12, namely the wall 14*d*. The structure 40 comprises three walls 44*a*, 44*b*, 44*c*, the walls 44*a* and 44*c* being arranged as an extension of the walls 14*a* and 14*c* of the module 10, while the wall 44*b* is 10 parallel to the wall 14*d* and is connected to the walls 44*a* and 44*c* in order to delimit a receiving space 46 (FIG. 1) for receiving the cartridge 42. The cartridge 42 can be inserted into the space 46 in the direction of the arrow 47.

A closure 48 connected perpendicularly to the walls 14*d* and 44*b* is disposed at the bottom of the space 46 and comprises a connecting gate 50 adapted to connect the cartridge 42 hydraulically to the main reservoir 12 when the cartridge is inserted into the space 46. The closure 48 has a hole 52 communicating with an intermediate duct 54 between the reservoir 12 and the connecting gate 50. The duct 54 communicates with the reservoir 12 via a passage 56 in the wall 14*d*, facing the lower part of the package of non-woven fabric sheets 34.

The cartridge 42 is formed by a rigid casing 60 filled with ink and having a complementary shape to that of the space 46 into which it is to be inserted. The cartridge 42 comprises in the lower part an element 62 for transferring the ink and adapted to be connected to the member 50 when the cartridge 42 is inserted. The transfer element 62 is normally impervious to the ink, but permits ink flow when it is coupled to the connecting gate 50, so that the cartridge can be kept full of ink indefinitely, without the ink escaping through the element 62.

The cartridge 42 is closed at the top by a cover 66 which comprises means 68 which can be actuated selectively to bring the casing 60 into communication with the atmosphere. The communication means 68 comprise an element movable with respect to the cover 66 and displaceable from a rest position in which the casing 60 is separated from the external atmosphere, to an operative position in which the casing 60 is brought into communication with the external atmosphere, as will be explained more clearly hereinafter. The communication means 68 comprise in particular a hollow cylindrical body 72 slidable in the cover 66 and having an outer end 74 in the form of a button, while the end 76 directed towards the interior of the casing 60 is shaped like a nail or claw (FIG. 2), its function being to break open a diaphragm 78 of the cover 66.

In a first embodiment of the printing module 10 and the associated refill cartridge 42 (FIG. 1), the connecting gate 50 comprises a coupling member in the form of a hollow tubular element or pin 53 fixed to the closure 48 and coaxial with the hole 52, while the transfer element 62 comprises a cap 63 of soft impermeable material which can be pierced by the pin 53.

In a new cartridge still full of ink, the cylindrical body or plunger 72 is situated in the external rest position 73 (FIGS. 1, 4 and 6), while the diaphragm or membrane 78 is intact so that the ink cannot escape.

When the ink of the module 10 is spent, the operator inserts a new cartridge fully into the space 46 (FIG. 2), piercing the cap 63 with the pin 53 and simultaneously pressing the button 74, pushing it into the operative position 75, so that the diaphragm 78 is penetrated and ruptured. The upper part of the casing 60 is thus brought into communication with the atmosphere, thereby allowing the ink in the ink-containing chamber in the cartridge 42 to descend by gravity in the duct 54 and to be absorbed by capillarity by the package 34 of absorbent material.

The casing 60 of the cartridge 42 comprises an outwardly-projecting projection 80 (FIG. 1) which engages a corresponding groove 82 in the wall 44*b* when the cartridge is fully inserted in the space 46. The elastic compliance of the wall 44*b* allows for the passage of the projection 80 into the section 84 preceding the groove 82.

Figure 1:
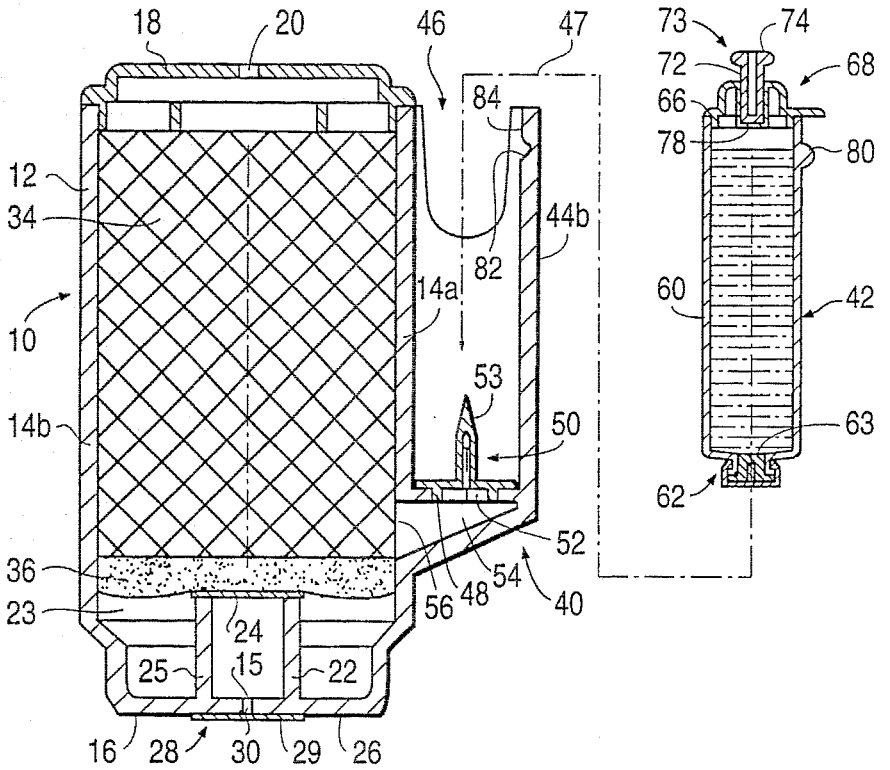
FIG. 1 is a vertical section of a printing module embodying the invention alongside a refill cartridge.
Figure 4:
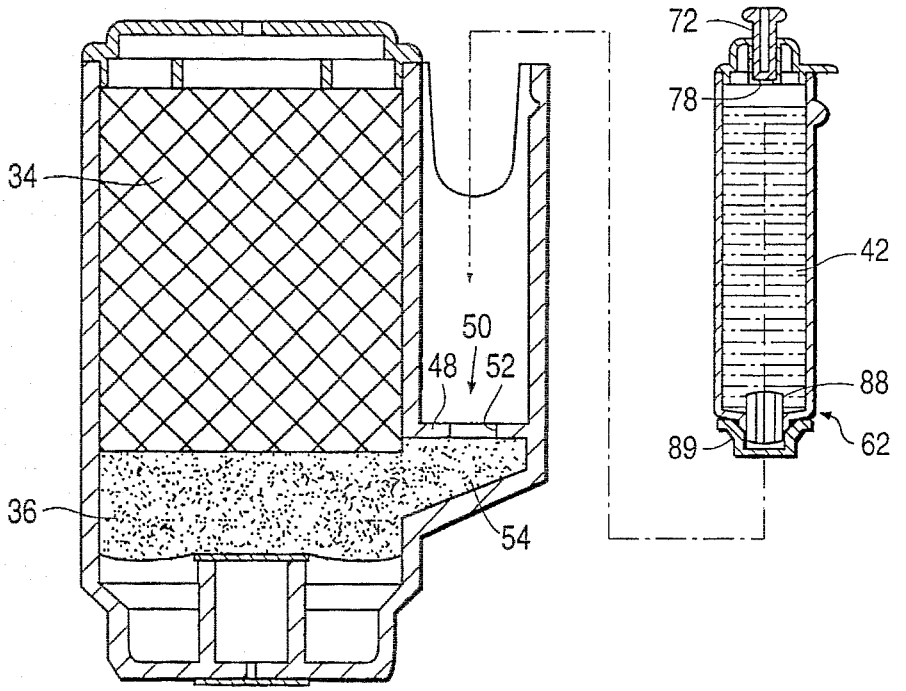
FIG. 4 is a vertical section of another embodiment of the module of FIG. 1 and of the associated refill cartridge.

FIGS. 4 and 5 show another module 10 and cartridge associated therewith embodying this invention. In these figures, parts identical to those of FIGS. 1 and 2 are not described in detail and are not numbered for the sake of simplicity. In this embodiment, the spongy body 36 extends into the duct 54 and is visible through the hole 52. The transfer element 62 comprises a fibrous or spongy member 88 inserted into the bottom of the cartridge 42 instead of the cap 63 of FIG. 1.

By virtue of the strong capillarity of the fibrous member 88 and as a result of the fact that, in a new and full cartridge, the cylindrical body 72 has not pierced the diaphragm 78 but rather lies with its end adjacent to it, the ink will not escape. Nevertheless, in order to prevent the operator getting his hands covered in ink by accidentally touching the fibrous member 88, a protective cap 89 is provided (FIG. 4).

When the refill cartridge 42 is fully inserted in the space 46' in FIG. 5, the fibrous member 88, freed of the protective cap, comes into contact via the hole 52 with the spongy body 36, which is normally still impregnated with ink and, by virtue of the capillary action of the member 88 and the body 36, the ink of the cartridge 42 flows into the package 34 through the spongy body 36.

FIG. 6 shows another variant of the module 10 and the associated cartridge 42 compared to the embodiments described hereinbefore. In FIG. 6, elements identical to those of the preceding figures are not described again in detail or numbered.

The cover 90 of the module 10 extends over the upper orifice of a space 92 equivalent to the space 46 of FIG. 1. A hollow cylindrical sleeve 94 is fixed to the cover 90 and extends in the interior of the space 92. The sleeve 94 is closed at the bottom by a wall 96 provided with a hollow pin 98 communicating with the inner part of the space 92 below the sleeve 94.

A refill cartridge 100 is provided in its lower part with a tubular element 102 closed by a cap 104, similar to the cap 63 of FIG. 1.

To supply ink from the cartridge 100 to the reservoir 12, the tubular element 102 is inserted into the sleeve 94, and once the cap 104 and the diaphragm 78 of the cartridge have been pierced, the ink contained in the cartridge can flow into the reservoir 12.

Figure 7:
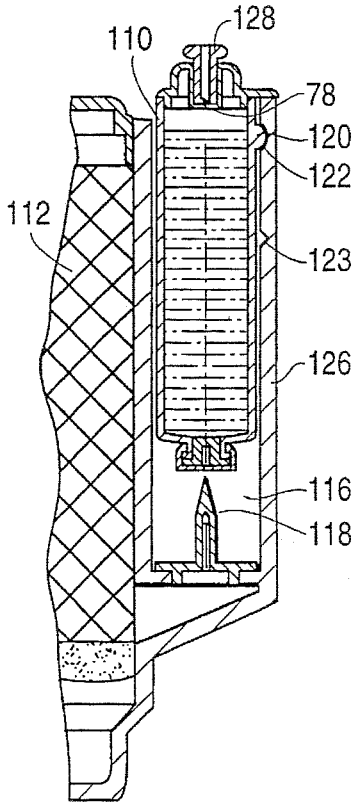
FIG. 7 shows a variant of FIG. 1, in which the refill cartridge has two fixed positions in the receiving opening of the module.

FIG. 7 shows another method of coupling a refill cartridge 110 to a module 112 according to another embodiment of this invention. The new module 112 is already provided at the time of manufacture with the cartridge 110, either of the type shown in FIG. 1 or of the type shown in FIG. 4, inserted into the space 116, but, in this embodiment, the cartridge 110 is kept at a distance from the coupling member 118 by the engagement of an external projection 120 of the cartridge with a first groove 122 formed in a wall 126 of the space 116. When it is necessary to refill the module 112 with ink, the refill operation is simplified to the maximum. The operator has only to press a button 128 in order to push the cartridge into the bottom of the space 116 and to open the diaphragm 78, so that the cartridge is displaced into the position shown in FIG. 2 and is held in this position by the engagement of the projection 120 with a second groove 123 disposed in a lower position with respect to the groove 122.

In order to facilitate transportation and storage of a certain number of cartridges of the type described above without excessive space being required to receive them, the volume of ink contained in a cartridge is kept in a ratio of approximately ⅓ of the volume of ink contained in a new module, which, as already stated above, will be around 5–6 $cm^3$. Consequently, the external dimensions of each cartridge will also be in a similar ratio with respect to the dimensions of the module to be refilled.

It will be understood that additions and/or modifications can be made to parts or embodiments of the thermal ink jet printing module according to the invention without thereby going beyond the scope of this invention.

We claim:

1. A refillable ink jet printing module, comprising:

a reservoir containing ink;

a thermal ink jet printing head fixed to and communicating with said reservoir;

housing means integral with said reservoir for receiving and housing an ink cartridge containing a fresh ink supply; and connecting means included in said housing means for supplying said reservoir with said fresh ink supply from said ink cartridge in said housing means;

said housing means comprising a first stop for holding said cartridge in a first position separated from said connecting means, and a second stop for holding said cartridge in a second position in engagement with said connecting means, and said cartridge comprising a stop element cooperating selectively with said first and second stops.

2. A refillable ink printing module, comprising:

a reservoir;

an absorbent body contained in said reservoir and impregnated with ink;

a thermal ink jet printing head fixed to and communicating with said reservoir;

housing means integral with said reservoir for receiving and housing an ink cartridge containing a fresh ink supply, and connecting means provided on said housing means for supplying said reservoir with said fresh ink supply from said cartridge in said housing means, said reservoir being closed by a cover of an opposite end of said reservoir from said head, said cover extending to close said housing means and comprising a sleeve adapted to receive said ink cartridge, said sleeve comprising a coupling member hydraulically connected to said reservoir to transfer said fresh ink supply from said ink cartridge to said reservoir.

3. A refillable ink jet printing module, comprising:

a reservoir;

an absorbent body contained in said reservoir and impregnated with ink;

a thermal ink jet printing head fixed to and communicating with said reservoir;

housing means integral with said reservoir for receiving and housing an ink cartridge containing a fresh ink supply, said ink cartridge comprising a transfer element for transferring said fresh ink supply; and connecting means provided on said housing means for selectively connecting hydraulically said reservoir to said transfer element of said ink cartridge in said housing means to transfer said fresh ink supply from said cartridge to said reservoir, wherein said housing means comprises a first stop for holding said cartridge in a first position separated from said connecting means, and a second stop for holding said cartridge in a second position in engagement with said connecting means, and said cartridge comprises a stop element cooperating selectively with said first and second stops.

4. A printing module as claimed in claim 1, in which said connecting means comprises a hollow tubular dement, and said transfer dement comprises a closure of soft resilient material adapted to be pierced by said tubular element.

5. A printing module as claimed in claim 1, in which said connecting means comprises an orifice communicating with said reservoir and with said housing means, and said transfer dement comprises a capillary member mounted on said cartridge and adapted to contact said absorbent body by means of said orifice.

6. A printing module as claimed in claim 1, in which said cartridge comprises a closing cover at an opposite end of said cartridge from said transfer element, and a hollow cylindrical body slidable in said cover and having a first end to the exterior of said cartridge and a second end adapted to tear a portion of said cover in order to transfer ink from said cartridge to said reservoir as a result of external atmospheric pressure.

7. A printing module as claimed in claim 1, in which said absorbent body is made of a material selected in a group consisting of sponge, bundle of fibers, package of non-woven fabric and layers of non-woven fabric.

8. A printing module as claimed in claim 1, in which the volume of said fresh ink supply is substantially equal to ⅓ of the volume of the ink contained in said absorbent body of a new module.

9. A refillable ink jet printing module, comprising:

a reservoir;

an absorbent body contained in said reservoir and impregnated with ink;

an ink jet printing head fixed to and communicating with said reservoir;

a housing integral with said reservoir;

connecting means on said housing for communicating the interior of said housing with said reservoir; and an ink cartridge in said housing, said ink cartridge comprising:

an ink-containing chamber having a first end and a second end;

outlet means at said first end of said chamber, said outlet means sealing said first end of said chamber until ink is required to replenish said reservoir, and said outlet means permitting ink to leave said chamber into said connecting means when ink is required to replenish said reservoir; and said outlet means having a first position in which said outlet means seals said first end of said chamber and has a second position in which said outlet means permits ink to leave said chamber to flow into said connecting means; and cover means at said second end of said chamber, said cover means sealing said second end of said chamber until ink is required to replenish said reservoir, and said cover means permitting air to flow into said chamber when ink is required to replenish said reservoir, wherein said module further comprises inter-engaging stop means on said housing and said cartridge for holding said cartridge with said outlet means selectively in said first position and in said second position thereof.

10. A printing module as claimed in claim 9, in which said ink cartridge is displaced in said housing to move said outlet means from said first position to said second position thereof.

11. A printing module as claimed in claim 9, in which said cover means comprises:

a membrane sealing said second end of said chamber;

a cover member over said membrane and having an aperture therethrough; and a plunger mounted in said aperture for movement therein between a first condition where said plunger lies adjacent said membrane and a second condition where said plunger penetrates and ruptures said membrane; and wherein manual activation of said plunger relative to said housing both causes said plunger to move from said first condition to said second condition to rupture said membrane permitting said chamber to communicate with ambient atmosphere, and causes said outlet means to move from said first position to said second position to permit ink to pass from said chamber through said connecting means to replenish said reservoir.

* * * * *